US005267660A

United States Patent [19]

Kwon

[11] Patent Number: 5,267,660

[45] Date of Patent: Dec. 7, 1993

[54] HOLDING PLATE FOR GOLF CLUBS

[76] Inventor: Oh Y. Kwon, House No. 30-612, Unbangwool Apt., Banpo-dong, Seocho-ku, Seoul, Rep. of Korea

[21] Appl. No.: 814,107

[22] Filed: Dec. 26, 1991

[30] Foreign Application Priority Data

Dec. 31, 1990 [KR] Rep. of Korea ..... 22051/90

[51] Int. Cl.[5] ..... A47F 5/00

[52] U.S. Cl. ..... 211/70.2; 206/315.6

[58] Field of Search ..... 211/70.2, 89; 206/315.6

[56] References Cited

U.S. PATENT DOCUMENTS

| | | | |
|---|---|---|---|
| 2,023,792 | 12/1935 | Sampson | 206/315.6 X |
| 2,114,870 | 4/1938 | Colkins | 206/315.6 |
| 4,176,752 | 12/1979 | Taber | 211/70.2 X |
| 4,664,382 | 5/1987 | Palmer et al. | 206/315.6 X |
| 4,753,446 | 6/1988 | Mills | 206/315.6 X |
| 5,094,345 | 3/1992 | Yonnetti | 206/315.6 X |

FOREIGN PATENT DOCUMENTS

| | | | |
|---|---|---|---|
| 2646785 | 11/1990 | France | 206/315.6 |

*Primary Examiner*—Robert W. Gibson, Jr.
*Attorney, Agent, or Firm*—Weil, Gotshal & Manges

[57] ABSTRACT

The present invention relates to a holding plate apparatus for golf clubs which is installed in a golf bag. The apparatus has three plates, an upper plate made of a rigid material, an intermediate plate made of an elastic material, and a bottom plate made of a rigid material. The three plates are assembled together, with the openings in each plate aligned with those of the other two plates. The holes in the elastic intermediate plate are made slightly smaller than the corresponding holes in the upper and lower plates such that when a golf club is inserted through the plates it makes contact only with the elastic material. The lower plate is of a form such that it mounts on the partitioning walls of a conventional golf bag. The intermediate plate also includes gripping openings such that the clubs may be either loosely placed in the large opening or firmly held in place by use of the small gripping opening.

9 Claims, 5 Drawing Sheets

HOLDING PLATE FOR GOLF CLUBS

BACKGROUND OF THE INVENTION

The present invention relates to a holding plate apparatus for the purpose of orderly arrangement of a plurality of golf clubs in a golf bag and more particularly to a holding plate apparatus for golf clubs that allows the golf clubs to be put in and taken out with ease and which prevents noise and damage when the golf bags are moved.

When golf clubs are carried inside a golf bag, it is preferable to have a device for preventing free movement of the golf clubs and which also enables the clubs to be put in and taken out with ease. Individual tubes for holding golf clubs in a golf bag are available. But, when the golf clubs are put in separate tubes, the golf clubs are shaken together with their tubes and move freely. Also the tubes have a tendency to come out simultaneously with the golf clubs when a single holding device for more than about 14 tubes is used. Also, the golf clubs inside each tube move freely and the upper part of the golf club shafts may be damaged by friction.

SUMMARY OF THE INVENTION

In order to solve these problems, prior Korean Utility Model application No. 90-14292 of the present applicant was suggested, but it has merely a single plate of guide holes and fixing slits without any means for providing the necessary elasticity.

The improved golf bag holding plate apparatus of the present invention is of the appropriate size to fit into the opening of the golf bag. Its upper and bottom plates are made of rigid synthetic resin, and the intermediate plate is made of an elastic material. Therefore, each golf club can be easily fixed, partially fixed, or simply put in the golf bag without any of the above plates.

DETAILED DESCRIPTION OF THE PREFERRED EMBODIMENT

Figure 1:
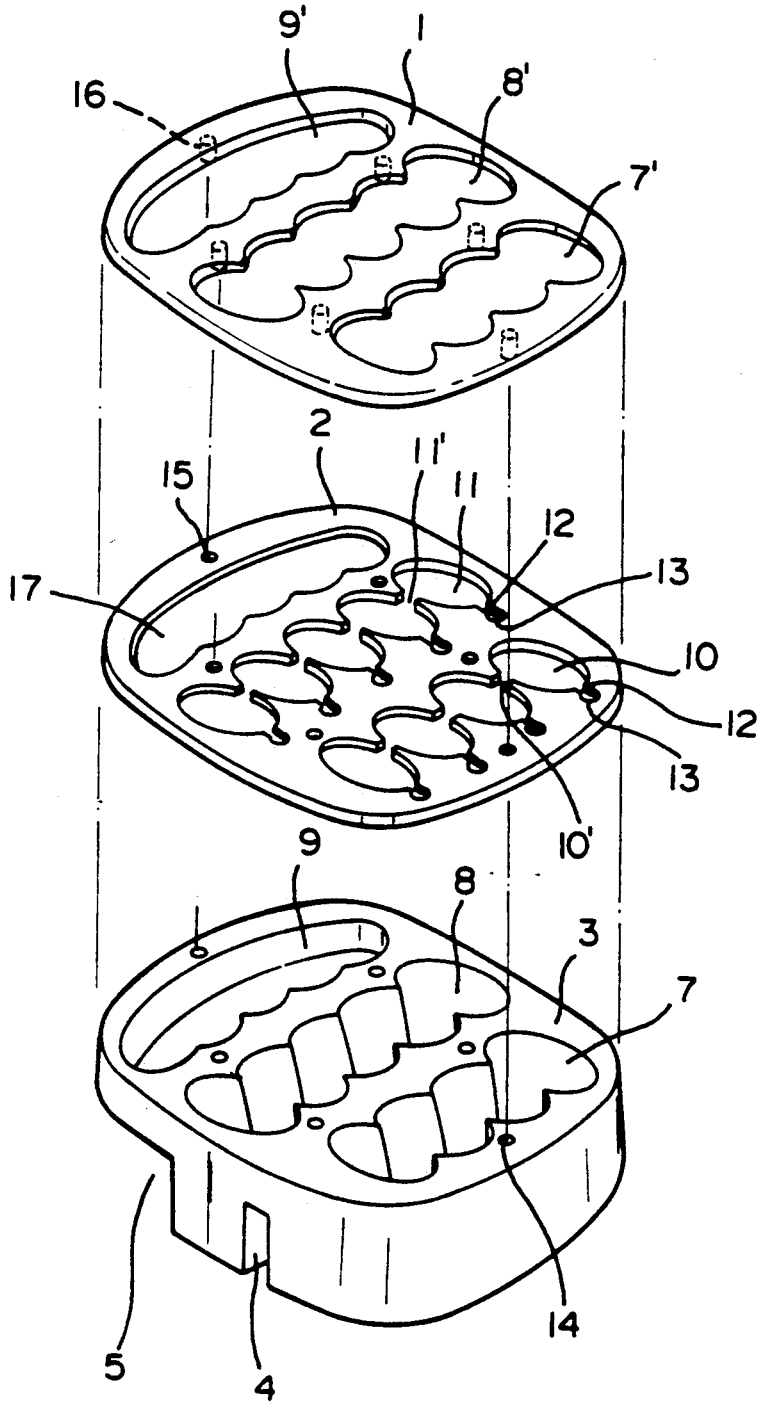
FIG. 1 is an exploded perspective view of the invention.

In FIG. 1, the upper plate (1) and the bottom plate (3) of the golf club holder of the present invention are made of rigid synthetic resin, and the intermediate plate (2) comprises flexible synthetic resin or rubber. The bottom plate (3) is downwardly extended so that the bottom golf club guide protrusions (7) (8) (9) prevent free movement of the golf clubs. The bottom golf club guide protrusions (7) (8) are comprised of a plurality of elliptical openings and the bottom golf club guide protrusion (9) is comprised of one long hole. Upper plate openings (7') (8') (9') correspond with bottom plate openings (7) (8) (9).

The intermediate plate (2) of elastic material has elliptical intermediate plate openings (10) (11), the major portions of which are shaped and positioned to align with upper plate openings (7') (8') and bottom plate openings (7) (8). In addition, intermediate plate (2) has cut-out channels (10') (11'), and gripping openings consisting of insertion slit (12) and insertion hole (13).

Figure 2:
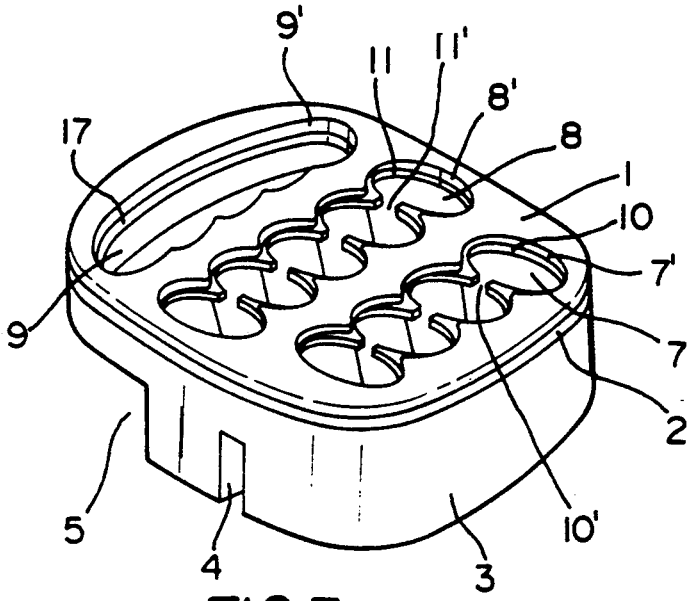
FIG. 2 is an assembled perspective view of the invention.
Figure 3:
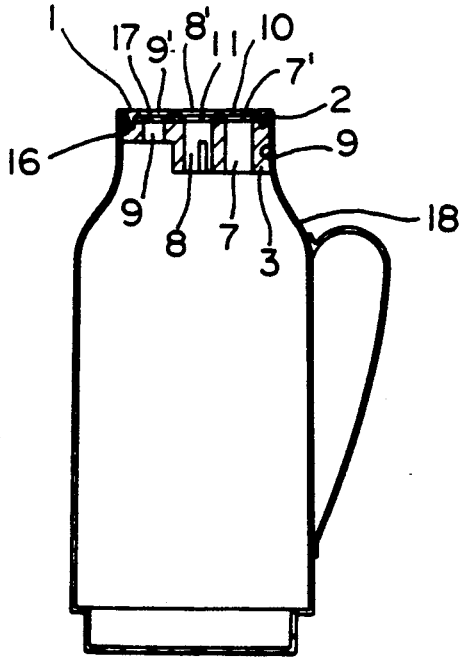
FIG. 3 is a side elevational view the golf bag equipped with the assembled plates of the invention.

The bottom plate (3) has a plurality of holes (14) extending therethrough, each of which has corresponding holes in the intermediate plate (2). The upper plate (1) has corresponding depending assembly protrusions (16) such that the three plates may be aligned and assembled together as shown in FIGS. 2 and 3. The above protrusions (16) can be replaced with screws. Under the bottom plate, portions (4) (5) are fitted to partitioned walls inside the opening of a typical golf bag (18).

As is apparent from the figures, intermediate plate openings (10) (11) are slightly smaller than the corresponding upper plate openings (7') (8') so that the part of the golf club in contact with the holding plate apparatus is prevented from any damage resulting from scratching or friction and at the same time the grips of the clubs are not entangled.

Iron clubs are put in upper plate openings (7') (8') and wood clubs are put in elongated hole (9'). The openings (7) (7') (8) (8') are such that any part of the golf club can have stable and flexible contact with the inner periphery of the hole.

Figure 4:
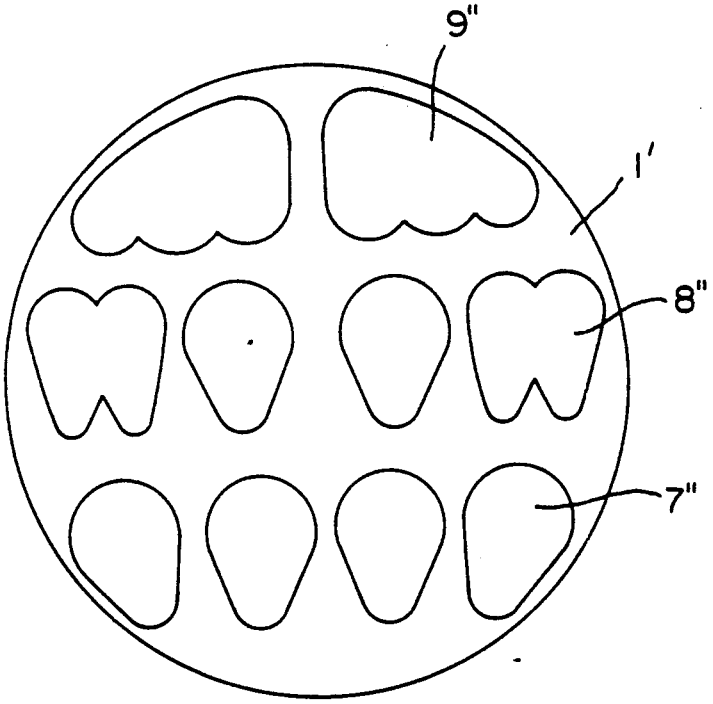
FIG. 4 is a plan view of a possible embodiment of the upper plate of the invention.

As shown in FIG. 4, if large-sized or otherwise special guide holes are desired, the upper plate openings can be formed as single holes (7''), or as double-sized holes (8''), or as triple-sized holes (9'') such that openings of all three plates correspond in alignment.

Figure 5:
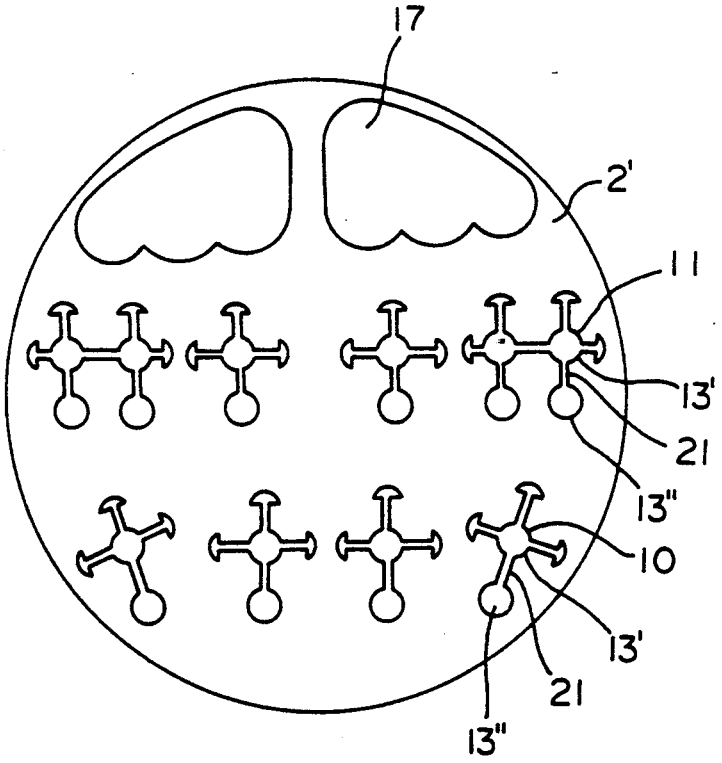
FIG. 5 is a plan view of a second possible embodiment of the intermediate plate of the invention.
Figure 6:
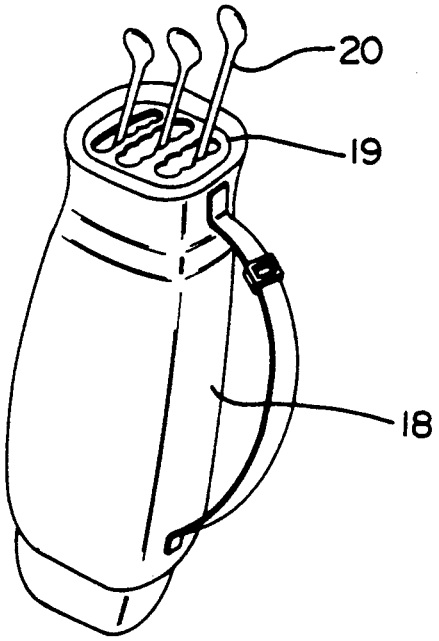
FIG. 6 is a perspective view of a golf bag showing the actual use of the invention.

In another embodiment shown in FIG. 5, the intermediate plate (2) can have golf club holding cut-outs consisting of center holes (13') connected to end insertion holes (13'') by slots (21). The golf club holding cut-outs of intermediate plate (2) can have various other forms. Also, the present invention can be an integral part of the golf bag instead of a separable component.

I claim:

1. A holding plate apparatus for organizing and limiting the movement of golf clubs in a conventional golf bag having one or more partitions comprising:

an upper plate of rigid material including a plurality of upper plate openings having a cross-sectional area substantially larger than the cross-sectional area of the golf club shaft so that upon insertion of a golf club in one of said openings, the club may move freely within the opening.

an intermediate plate of elastic material including a plurality of intermediate plate openings, the major portions of which have substantially the same shaped cross-section as the upper plate openings, at least some of the intermediate plate openings further including gripping openings having a cross-sectional area slightly smaller than the cross-sectional area of the shaft, so that when the shaft is forced into the gripping opening, it is held against movement by the material of the intermediate plate, a bottom plate of rigid material including a plurality of bottom plate openings having a cross-section substantially the same as the upper plate openings and means for attaching said bottom plate to a golf bag.

the plates being assembled such that the upper plate, intermediate plate, and bottom plate openings in all three plates are in alignment with each other, but wherein the major portions of said intermediate plate openings are slightly smaller than the upper plate openings and bottom plate openings so that upon insertion of a golf club in the assembled apparatus, the golf club shaft is contacted only by the intermediate plate.

2. A holding plate apparatus as defined in claim 1 wherein said bottom plate downwardly extends such that said bottom plate openings comprise golf club guide protrusions and further including surfaces that are adapted to mount on the partitions in a conventional golf bag.

3. A holding plate apparatus as defined in claim 1 wherein said plates are assembled using a plurality of assembly protrusions in said upper plate and corresponding holes in each of said intermediate and lower plates such that said assembly protrusions will hold in place said intermediate and lower plates upon assembly of the three plates.

4. A holding plate apparatus as defined in claim 2 wherein said upper plate openings comprise three sets of parallel openings, two of said sets of parallel openings comprising elliptically-shaped openings adjacent to each other and overlapping along the longitudinal axis, the third said set of parallel openings comprising an elongated opening, said intermediate plate major openings comprise openings having substantially the same cross-section as the upper plate openings, and said bottom plate openings comprise openings having substantially the same cross-section as the upper plate openings.

5. A holding plate apparatus as defined in claim 4 wherein said plates are assembled using a plurality of assembly protrusions in said upper plate and corresponding holes in each of said intermediate and lower plates such that said assembly protrusions will hold in place said intermediate and lower plates upon assembly of the three plates.

6. A holding plate apparatus as defined in claim 1 wherein the gripping openings in said intermediate plate comprise slits extending radially outward from said elliptically shaped holes and terminating in openings having a cross-sectional area slightly smaller than the cross-sectional area of the shaft so that when the shaft is forced into said opening, it is held against movement by the material of the intermediate plate.

7. A holding plate apparatus as defined in claim 6 wherein said plates are assembled using a plurality of assembly protrusions in said upper plate and corresponding holes in each of said intermediate and bottom plates such that said assembly protrusions will hold in place said intermediate and lower plates upon assembly of the three plates.

8. A holding plate apparatus for organizing and limiting the movement of golf clubs in a conventional golf bag having one or more partitions comprising:

an upper plate of rigid material including a plurality of upper plate openings having a cross-sectional area substantially larger than the cross-sectional area of the golf club shaft so that upon insertion of a golf club in one of said openings, the club may move freely within the opening, some of which said upper plate openings overlap forming larger openings, an intermediate plate of elastic material including a plurality of golf club holding cut-outs, said cut-outs comprising circular openings of sufficient cross-sectional area to permit insertion of a golf club shaft, and further comprising slots extending radially outward from said circular openings and equally spaced, some of which said slots terminate in gripping openings having a cross-sectional area slightly smaller than the cross-sectional area of the shaft, so that when the shaft is forced into the gripping opening, it is held against movement by the material of the intermediate plate, and some of which said slots may terminate in an adjacent circular opening, a bottom plate of rigid material including a plurality of bottom plate openings having a cross-section substantially the same as the upper plate openings and means for attaching said bottom plate to a golf bag, the plates being assembled such that the upper plate openings, bottom plate openings, and intermediate plate golf club holding cut-outs are in alignment with each other.

9. A holding plate apparatus as defined in claim 8 wherein said plates are assembled using a plurality of assembly protrusions in said upper plate and corresponding holes in each of said intermediate and lower plates such that said assembly protrusions will hold in place said intermediate and lower plates upon assembly of the three plates.

* * * * *